US005773801A

United States Patent [19]

Blamer et al.

[11] Patent Number: 5,773,801

[45] Date of Patent: Jun. 30, 1998

[54] MICROWAVE COOKING CONSTRUCTION FOR POPPING CORN

[75] Inventors: Robert Harmon Blamer, Plymouth; Denise Ellen Hanson, Elk River, both of Minn.

[73] Assignee: Golden Valley Microwave Foods, Inc., Edina, Minn.

[21] Appl. No.: 724,157

[22] Filed: Oct. 1, 1996

Related U.S. Application Data

[63] Continuation of Ser. No. 389,755, Feb. 15, 1995, abandoned.

[51] Int. Cl.[6] ..... H05B 6/80

[52] U.S. Cl. ..... 219/727; 219/730; 426/107; 426/234; 99/DIG. 14

[58] Field of Search ..... 219/727, 730, 219/759; 426/107, 113, 234, 241, 243; 99/DIG. 14

[56] References Cited

U.S. PATENT DOCUMENTS

| | | |
|---|---|---|
| 2,041,227 | 5/1936 | Chalmers . |
| 2,149,872 | 3/1939 | Schmidt . |
| 2,628,764 | 2/1953 | Rubinstein et al. . |
| 2,741,559 | 4/1956 | Banowitz . |
| 3,008,835 | 11/1961 | Madding . |
| 3,027,261 | 3/1962 | Samara . |
| 3,035,754 | 5/1962 | Meister . |
| 3,036,616 | 5/1962 | Allen . |
| 3,052,554 | 9/1962 | Colman . |
| 3,207,420 | 9/1965 | Navarrete-Kindelan . |
| 3,286,832 | 11/1966 | Pilger . |
| 3,293,048 | 12/1966 | Kitterman . |
| 3,317,118 | 5/1967 | Harrison et al. . |
| 3,637,132 | 1/1972 | Gray . |
| 3,671,270 | 6/1972 | Jehn . |
| 3,689,291 | 9/1972 | Draper . |
| 3,835,280 | 9/1974 | Gades et al. . |
| 3,851,574 | 12/1974 | Katz et al. . |
| 3,853,612 | 12/1974 | Spanoudis . |
| 3,873,735 | 3/1975 | Chalin et al. . |
| 3,970,241 | 7/1976 | Hanson . |
| 3,973,045 | 8/1976 | Brandberg et al. . |
| 4,038,425 | 7/1977 | Brandberg et al. . |
| 4,190,757 | 2/1980 | Turpin et al. . |
| 4,219,573 | 8/1980 | Borek . |
| 4,230,924 | 10/1980 | Brastad et al. . |
| 4,267,420 | 5/1981 | Brastad . |

(List continued on next page.)

FOREIGN PATENT DOCUMENTS

| | | |
|---|---|---|
| 449465 | 6/1948 | Canada . |
| 692877 | 8/1964 | Canada . |
| 1069861 | 1/1980 | Canada . |
| 81544 | 7/1956 | Denmark . |
| 0 276 654 | 1/1988 | European Pat. Off. . |
| 0 357 008 | 8/1988 | European Pat. Off. . |
| 0 312 333 | 10/1988 | European Pat. Off. . |
| 1786047 | 11/1971 | Germany . |
| 2 202 118 | 9/1988 | United Kingdom . |
| PCT/US93/ 00849 | 8/1993 | WIPO . |

OTHER PUBLICATIONS

Exhibit A (Packaging Concepts, Inc. Popcorn Popping Bag) with attached Declaration of Robert H. Blamer (w/attached photo Exhibits 1–5).

Exhibit B (Orville Redenbacher's Popcorn Popping Bag) with attached Declaration of Denise E. Hanson (w/attached photo Exhibits 6–11).

*Primary Examiner*—Philip H. Leung

*Attorney, Agent, or Firm*—Merchant, Gould, Smith, Edell, Welter & Schmidt, P.A.

[57] ABSTRACT

A construction for container charge of popcorn to be heated in a microwave heating operation is provided. The construction generally comprises a flexible single-ply bag having a microwave interactive construction secured thereto. A variety of embodiments are described. An arrangement including a charged popcorn therein is also provided. Further, methods of constructing such arrangements of methods of use are described.

12 Claims, 6 Drawing Sheets

U.S. PATENT DOCUMENTS

| | | | |
|---|---|---|---|
| 4,292,332 | 9/1981 | McHam . | |
| 4,404,241 | 9/1983 | Mueller . | |
| 4,450,180 | 5/1984 | Watkins . | |
| 4,461,031 | 7/1984 | Blamer . | |
| 4,518,651 | 5/1985 | Wolfe, Jr. . | |
| 4,548,826 | 10/1985 | Watkins . | |
| 4,553,010 | 11/1985 | Bohrer et al. . | |
| 4,571,337 | 2/1986 | Cage et al. . | |
| 4,584,202 | 4/1986 | Roccaforte . | |
| 4,604,854 | 8/1986 | Andreas . | |
| 4,641,005 | 2/1987 | Seiferth . | |
| 4,678,882 | 7/1987 | Bohrer et al. . | |
| 4,691,374 | 9/1987 | Watkins et al. . | |
| 4,698,472 | 10/1987 | Cox et al. . | |
| 4,735,513 | 4/1988 | Watkins et al. . | |
| 4,825,024 | 4/1989 | Seaborne . | |
| 4,851,246 | 7/1989 | Maxwell et al. . | |
| 4,864,090 | 9/1989 | Maxwell et al. . | |
| 4,878,765 | 11/1989 | Watkins et al. . | |
| 4,904,488 | 2/1990 | LaBaw et al. . | |
| 4,943,456 | 7/1990 | Pollart et al. . | |
| 4,970,358 | 11/1990 | Brandberg et al. . | |
| 4,973,810 | 11/1990 | Brauner . | |
| 4,982,064 | 1/1991 | Hartman et al. . | |
| 5,006,405 | 4/1991 | Watkins et al. . | |
| 5,011,299 | 4/1991 | Black, Jr. et al. . | |
| 5,044,777 | 9/1991 | Watkins et al. . | |
| 5,079,083 | 1/1992 | Watkins et al. . | |
| 5,081,330 | 1/1992 | Brandberg et al. . | |
| 5,175,031 | 12/1992 | Ochocki . | |
| 5,189,272 | 2/1993 | McDonald et al. . | |
| 5,195,829 | 3/1993 | Watkins et al. | 383/100 |
| 5,211,975 | 5/1993 | Mendenhall et al. | 219/727 |
| 5,223,288 | 6/1993 | Mendenhall et al. | 426/107 |
| 5,294,765 | 3/1994 | Archibald et al. | 219/727 |
| 5,302,790 | 4/1994 | Turpin . | |
| 5,306,512 | 4/1994 | Blamer . | |
| 5,344,661 | 9/1994 | Mendenhall et al. | 426/107 |
| 5,357,086 | 10/1994 | Turpin et al. . | |
| 5,405,663 | 4/1995 | Archibald et al. . | |
| 5,461,216 | 10/1995 | McDonald | 219/727 |

FIG. 11
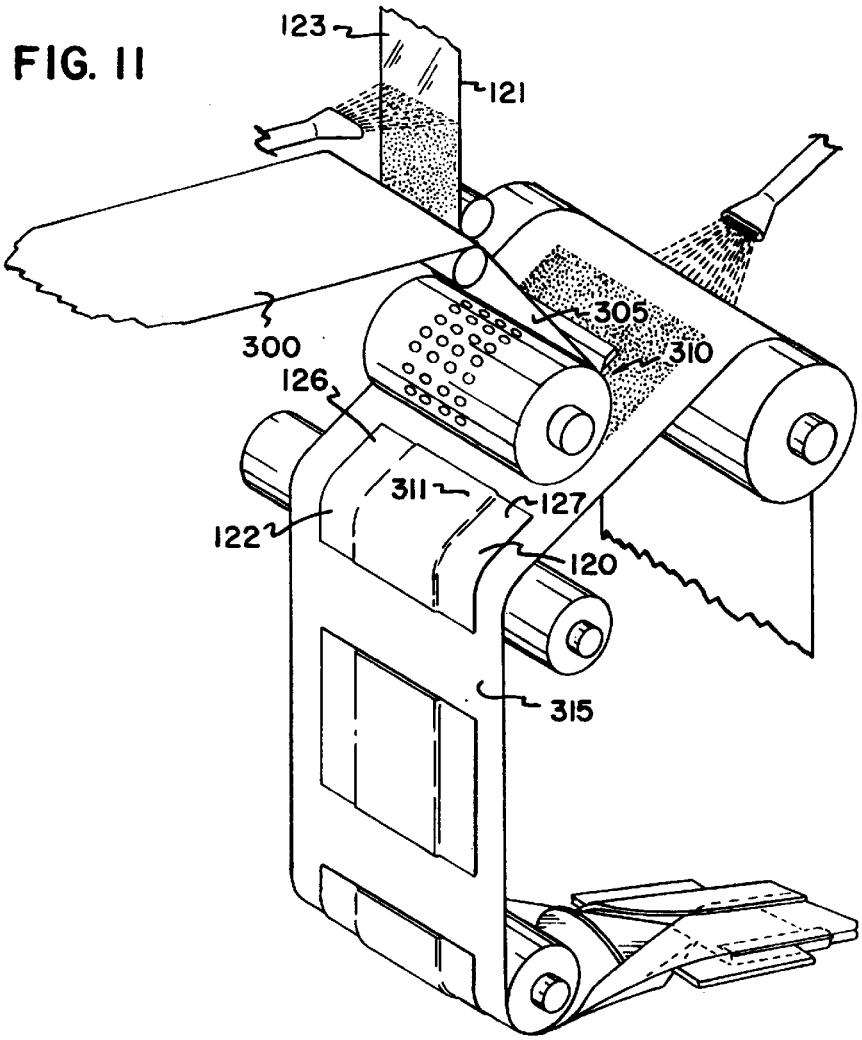
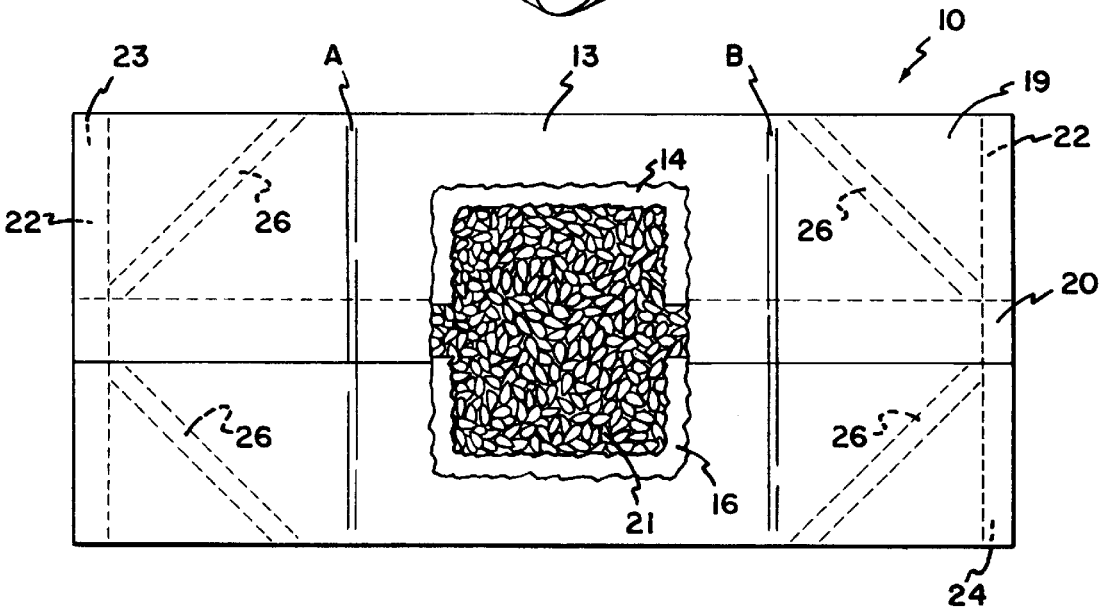
FIG. 5

FIG. 6
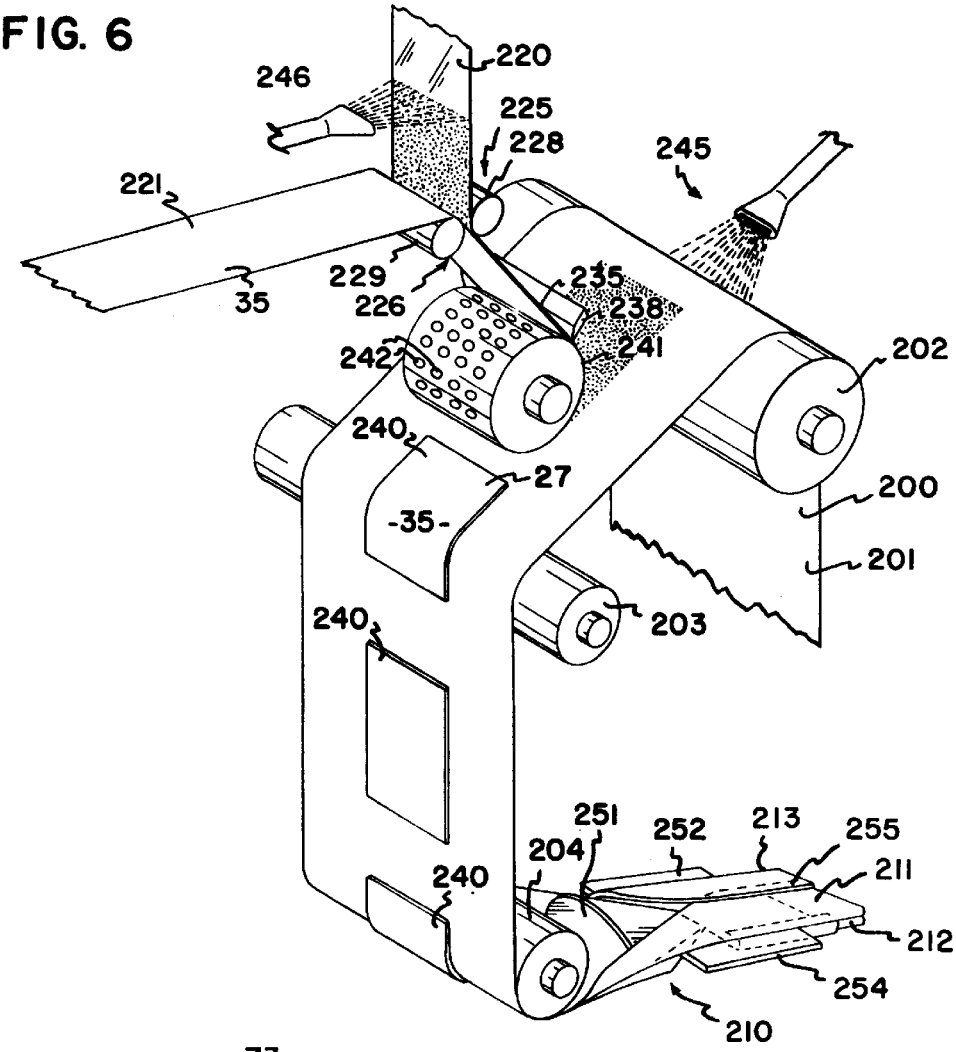
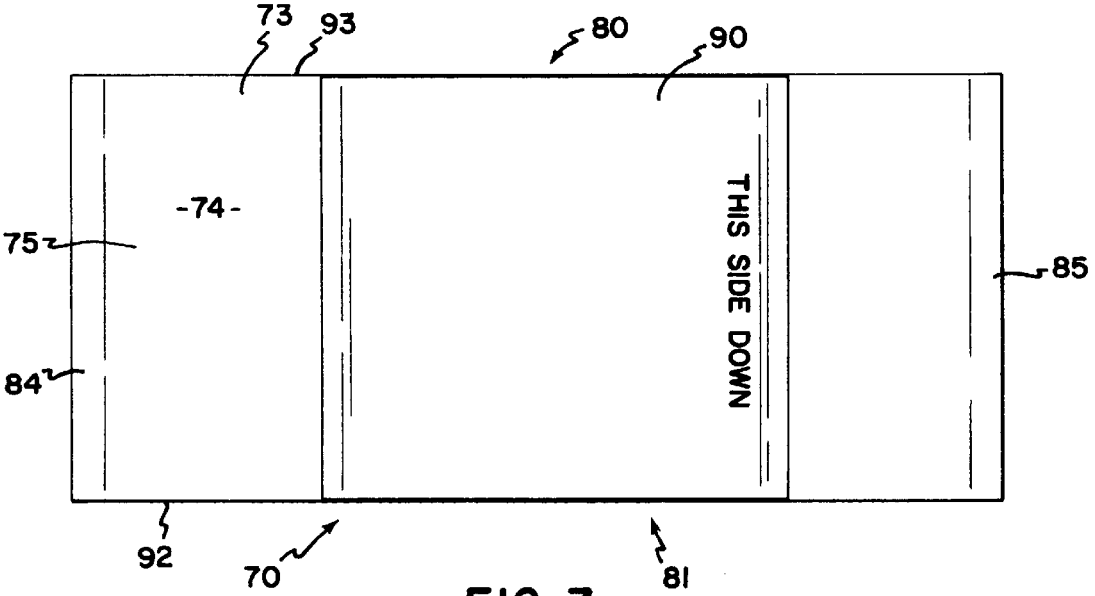
FIG. 7

FIG. 9
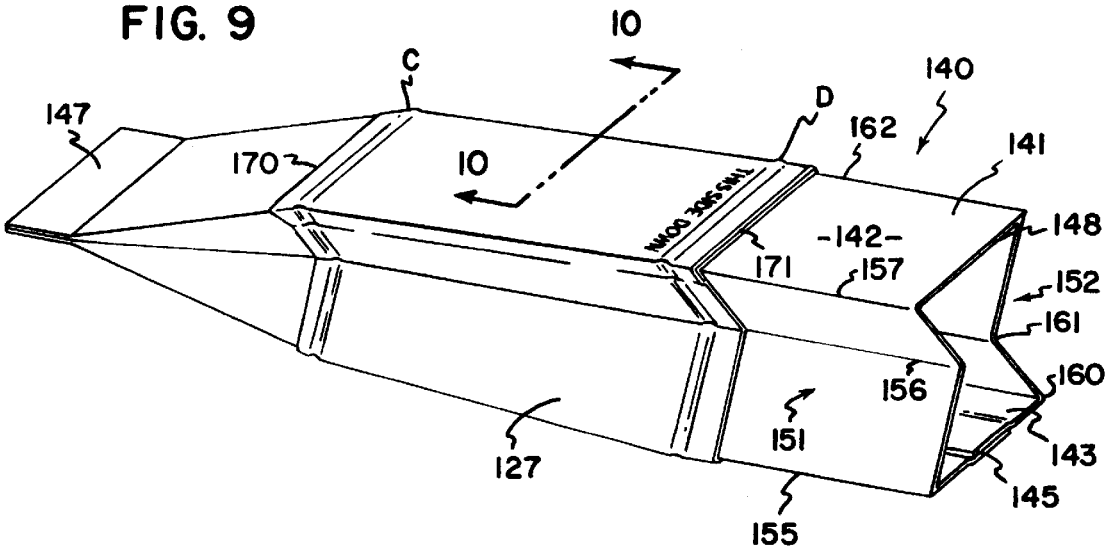
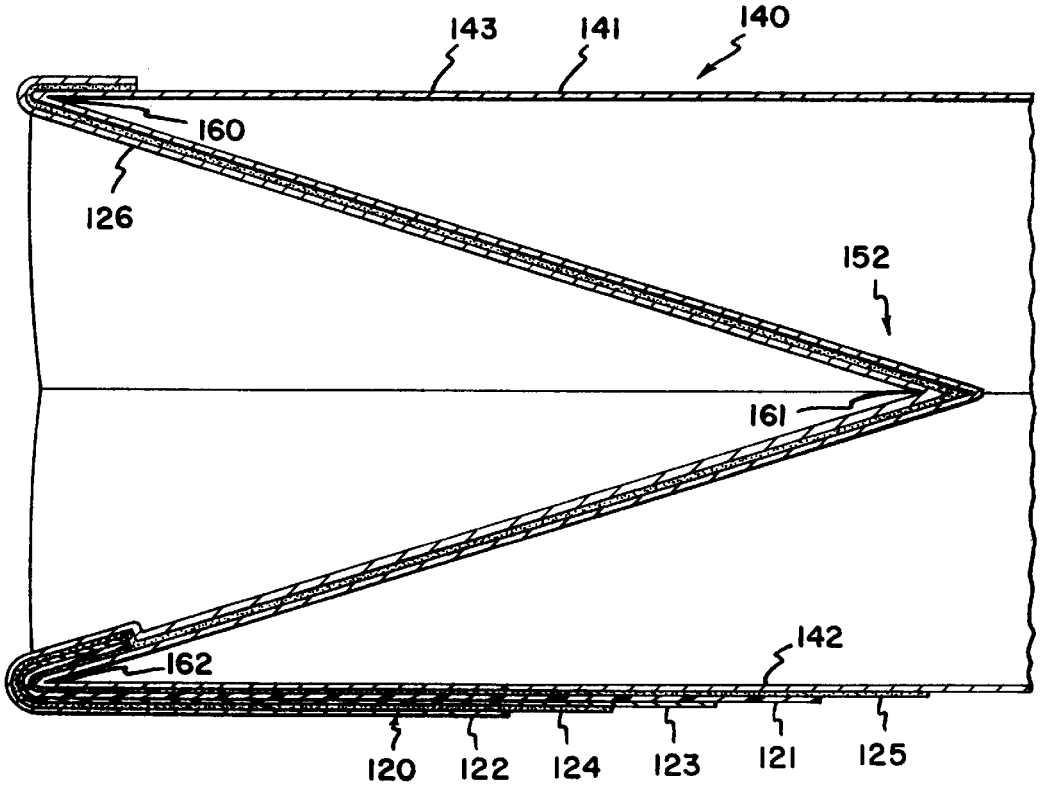
FIG. 10

MICROWAVE COOKING CONSTRUCTION FOR POPPING CORN

This application is a Continuation of application Ser. No. 08/389,755, filed Feb. 15, 1995, now abandoned.

FIELD OF THE INVENTION

The present invention relates to microwave cooking constructions. The particular implementation described and shown concerns an improved package for use to pop popcorn in a microwave oven.

BACKGROUND OF THE INVENTION

Microwave popcorn popping constructions in common commercial use are multi-ply paper bags in which inner and outer paper sheets are laminated to one another with a microwave interactive construction encapsulated between the paper plies. Popcorn popping bags of this kind are described for example, in U.S. Pat. Nos. 4,904,488; 4,973,810; 4,982,064; 5,044,777; and, 5,081,330, the disclosures of which are incorporated here by reference.

A common feature of such constructions is that they are generally made from flexible paper materials. In this manner, the constructions are relatively inexpensive and sufficiently flexible to open or expand conveniently under steam pressure, when a popcorn charge therein is exposed to microwave energy. Also, the materials are sufficiently flexible to be formed from a sheet into a folded tube, during a continuous bag-construction process In general, a conventional microwave cooking operation of popcorn often results in the generation of a hot liquid oil. If the construction retaining the popcorn charge is paper, the paper must be sufficiently resistant to the passage of hot liquid oil therethrough, during the microwave processing to be satisfactory for performance of the product. That is, the oil should not leak from the construction during storage; and, when the microwave operation is undertaken, the hot liquid or liquified oil generated should not leak through the paper sufficiently to generate an undesirable greasy feel to the outside of the package, for the consumer.

In general, grease proof papers have been developed for utilization in constructions which must, to some extent, resist the passage of liquids, such as hot liquid oil, therethrough. In general, during construction of a grease proof paper, the pulp is abraded so when the grease proof treatment is cast on it, substantial hydrogen bonding in the cellulose occurs. This process of abrading the pulp is generally referred to as "refining". Typically, the more refined paper is, the more brittle it is. Thus, if a heavy, strongly grease proof, paper is utilized, a relatively rigid, brittle (non-flexible) construction results.

A general trend, then, is that while a paper system can be made relatively grease proof, for retaining of hot oil therein, such a construction will generally be brittle and not of a desirable flexibility or strength for ease of assembly, folding, filling, storage and/or use.

In order to provide some flexibility in the grease proof paper, modern grease proof papers involve some refinement of the pulp and some chemical treatment. With less refinement, the resulting paper is less brittle. However, in general, such grease proof papers have not been found to be fully desirable, by themselves, as the construction material for microwave cooking constructions, which in typical use may be required to retain hot liquid or liquified oil.

In general, conventional approaches for construction of flexible paper microwave systems have involved multi-ply constructions, having at least one layer of grease proof paper bonded to a layer of Kraft paper. The Kraft paper provides strength and integrity to the construction, whereas the grease proof paper provides for some resistance to oil or grease permeability. As a result of the composite construction, a paper material can be provided which is both flexible and resistant to oil transfer therethrough, without the problem of loss of integrity associated with a brittle grease proof system on its own.

While such constructions have provided for useable microwave constructions, especially those for retaining microwave popcorn, continued improvement is sought. In general, improvement with respect to the nature of materials, integrity during folding, storage, shipment and cooking, and convenience for the consumer, have been desirable.

SUMMARY OF THE INVENTION

According to the present invention a construction is provided for containing a charge of popcorn to be heated during a microwave heating operation. In general, the construction comprises a flexible, single-ply bag, preferably comprising flexible paper having a basis weight of no greater than about 45 lbs. per ream, more preferably a base weight of about 25–40 lbs. per ream. The construction includes a microwave interactive material secured to the bag. In certain preferred embodiments, the microwave interactive material is secured to an outer surface of the bag. By the term "flexible" in this and similar contexts, it is meant that the material is one which is easily deformed, in intended use, without permanent damage. The term "basis weight" in this and similar contexts means pound per ream or 3000 sq. ft. (432,000 sq. inch) based on 500 sheets (24"×36").

In one preferred embodiment the construction is such that the bag includes front and back panels with first and second opposite gussets extending therebetween. Each of the gussets generally comprises a first outwardly directed gusset fold whereat the gusset is secured to (or is contiguous with) the front panel; a second outwardly directed gusset fold whereat the gusset is secured to (or is contiguous with) the back panel; and, a third central inwardly directed gusset fold. The term "contiguous" in this context is meant to indicate that the panel and gusset are folded from the same piece of material. When a gusset is described as "secured to" a panel, the term "secured" is meant to include within its scope a construction in which the gusset and panel are contiguous, i.e. are folded from a single sheet.

In certain preferred embodiments, the microwave interactive construction includes a portion reinforcing a part of the first gusset fold, in each gusset, extending adjacent to a part of the bag whereat a charge of popcorn is located in use.

In preferred embodiments the microwave interactive construction comprises a laminate including a layer of flexible paper having a basis weight of no greater than about 45 lbs. per ream; a layer of flexible plastic material; and, a layer of microwave interactive metallic material positioned between the layer of flexible paper material and the layer of flexible plastic material.

In certain preferred embodiments, the microwave interactive construction is secured to an outer surface the bag with the layer of plastic material positioned between the metallic material and the single ply paper of the bag.

In one embodiment described, the microwave interactive construction includes a portion of the layer of flexible paper secured directly to the bag outer surface, without any portion of the plastic layer and the metallic layer therebetween. In the preferred embodiment utilizing this arrangement, such portions of the flexible paper are used to reinforce selected portions of the gusset folds.

In certain preferred arrangements, the construction includes first and second, spaced, transverse folds thereacross. The transverse folds preferably divide the construction into a central portion with first and second opposite and portions. The microwave interactive construction is appropriately positioned in such arrangements so that the majority of the surface area of the metallic material overlaps the central portion of the bag, i.e. extends between the two transverse folds. However, preferably at least a small portion of the metallic material in the microwave interactive construction extends beyond the transverse folds. Most preferably, this length of extension is within a range of about 0.25 inches to 0.5 inches. Alternatively, however, in some applications the metallic material can extend the entire length of the panel.

The present invention is also directed to constructions, as described, including a charge of popcorn therein. The charge of popcorn can include added fat/oil.

BRIEF DESCRIPTION OF THE DRAWINGS

FIG. 2 being taken generally along line 2—2 and showing the construction inverted relative to FIG. 1.

FIG. 5 is a top plan view of the arrangement shown in FIG. 1 depicted: filled with a popcorn charge; with portions broken away to show internal detail; and, with phantom lines indicating portions hidden from view and/or optional.

FIG. 6 is a diagrammatic perspective view showing a method of assembly of a construction according to the embodiment of the present invention.

FIG. 7 is a top plan view of a first alternate embodiment of the present invention.

FIG. 9 is a perspective view of an arrangement according to a second alternate embodiment of the present invention.

FIG. 10 is a cross-sectional view of a bag arrangement according to FIG. 9; FIG. 10 being depicted inverted relation to FIG. 9 and, being taken along line 10—10.

FIG. 11 is a diagrammatic prospective view showing a method of assembly for a construction according to the second alternate embodiment of the present invention.

DETAILED DESCRIPTION OF THE PRESENT INVENTION

Some Drawbacks to Conventional Constructions

Figure 1:
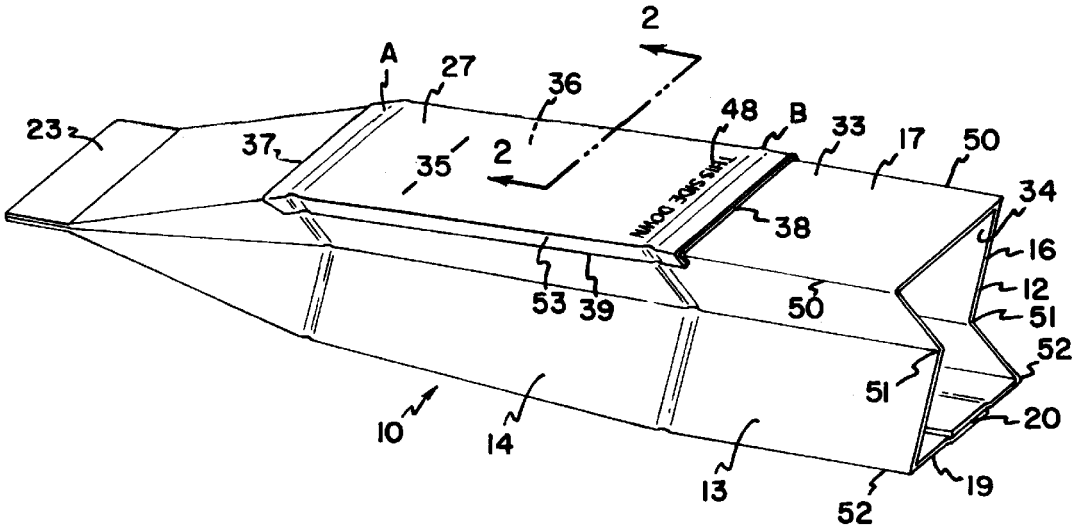
FIG. 1 is a perspective view of a construction according to a selected embodiment of the present invention.

While, in general, convention constructions have been useable as expandable microwave containers in which to store and pop popcorn products, they have not been entirely desirable. For example, multi-ply constructions require a substantial amount of glue between the plys for structural integrity. The glue adds weight and expense to the construction.

Also, in many flexible microwave packaging systems, seals within the system are heat seals. Relatively thick multi-ply systems require greater amounts of heat to be applied, to generate heat seals, due to absorption of (and dissipation of) the heat by the relatively thick paper. It would be desirable to use less paper, if possible, so that less heat could be applied (or less be wasted) during the heat sealing process.

Similarly, relatively thin, light weight, systems are easier to machine, i.e. manipulate to form the flexible constructions. Relatively thick, multi-ply, systems, especially if heavily reinforced with the glue, are less desirable with respect to this.

Further, it is desirable that a microwave construction inflate relatively quickly, as microwave energy is absorbed by the popcorn charge therein, to allow for a large, enclosed space in which the popcorn can easily pop and fluff. Relatively thick, multi-ply, systems are less flexible, (i.e. more stiff) then single-ply systems. It would be desired to provide less weight in the paper, if possible, so that a less stiff system will result, allowing for more easy inflation. Also, less weight or stiffness allows for rapid expansion of the bag even in low powered ovens, which cause a less rapid generation of steam.

Further, in general larger, thicker bags will absorb and retain more heat. It could be expected that if a lighter weight system, relative to conventional systems, could be developed, it would show advantageous characteristics with respect to cooling after the microwave heating operation. That is, thinner, lighter weight, bags will sometimes cool more rapidly after the microwave heating operation.

Some or all of the above drawbacks to conventional systems are addressed by the various constructions described herein.

Preferred Constructions—Generally

In general, constructions according to the present invention concern the utilization of preferred materials, in preferred manners, so that the relatively thick, bulky heavy constructions such as those previously utilized for microwave packaging systems can be avoided. For example, in some applications of the present invention the flexible bag is formed from a single ply of grease resistant paper, preferably having a basis weight no greater than about 45 lbs. per ream (or about 73 grams square meter), to which has been applied a microwave interactive construction. A reinforcing sheet of outer paper is applied in some locations, but not all, in the construction. In preferred embodiments, the multiple ply arrangement is located only in portions of the construction where the popcorn charge is positioned, and/or where susceptibility to leakage is the greatest. Throughout the remainder of such an arrangement or system, however, advantage is taken of the properties of the materials used, so that single ply constructions can be used.

A general construction of certain arrangements according to the present invention will be understood by reference to FIGS. 1–5. In FIG. 6, a method of manufacturing a specific construction in accord with the present invention is shown. Alternate embodiments are described and shown in FIGS. 7–12.

FIGS. 1–4

Figure 2:
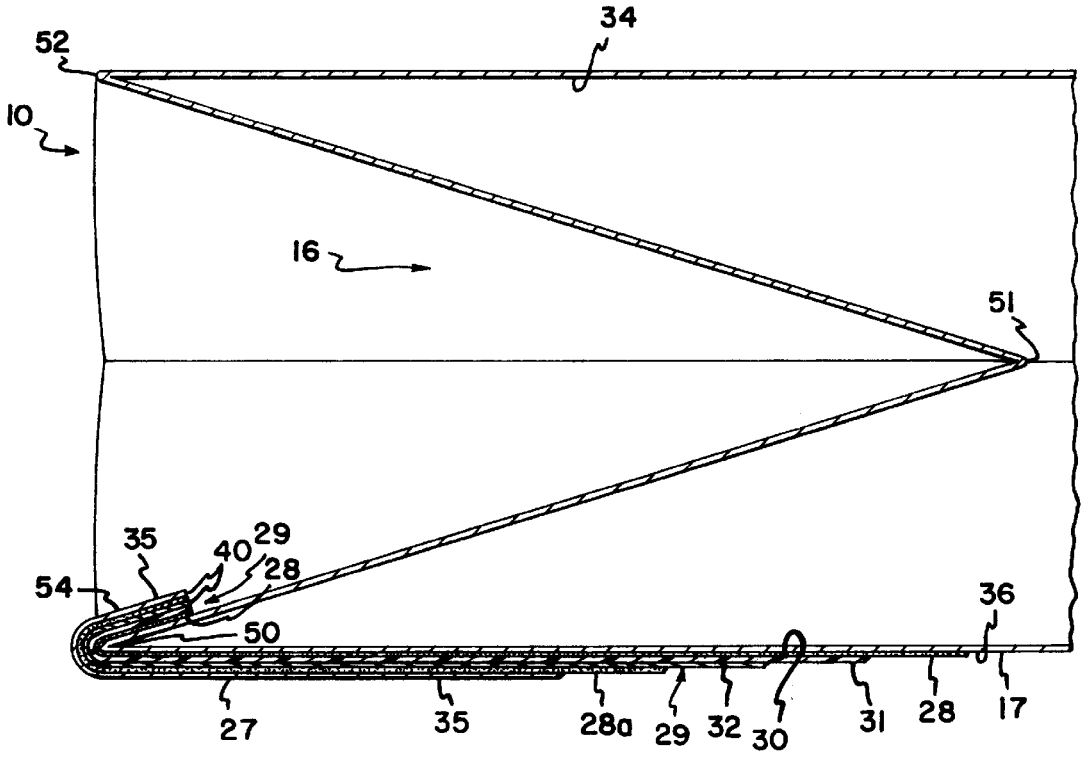
FIG. 2 is a fragmentary cross-sectional view of the arrangement shown in FIG. 1.
Figure 3:
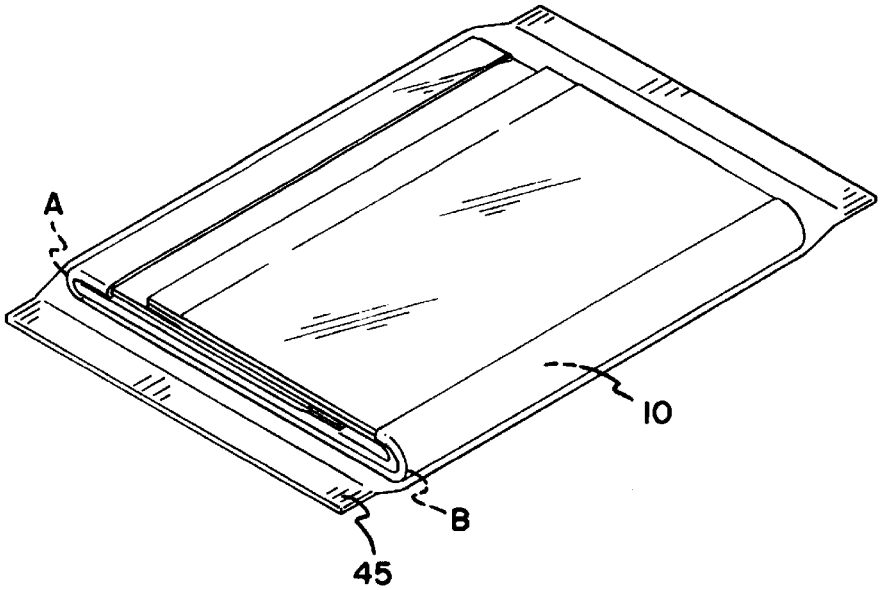
FIG. 3 is a perspective view of an arrangement according to FIG. 1, depicted folded and enclosed within a plastic film overwrap for storage and shipment.

In FIGS. 1, 2 and 5 a construction according to the present invention is indicated generally at 10.

Referring to FIGS. 1 and 2, the construction 10 includes a bag formed from a single ply of flexible paper material. In FIG. 1, the material 12 is shown configured as a bag 13 having centrally extending side folds 14 and 16 that join front and rear panels 17 and 19, respectively. Side folds 14 and 16 are conventional gusset folds. Preferably, they are sized so that a popcorn charge within construction 10 is retained in only one "side" of the arrangement 10, more specifically between portions of gussets 14,16 and panel 17, during storage and initial heating in accord with U.S. Pat. Nos. 4,604,854 and 4,548,826, incorporated herein by reference.

Referring to FIG. 1, the particular construction 10 is depicted as a tubular form and includes a longitudinally, extending seam 20 in rear wall or panel 19. In use (FIG. 5), a charge 21 of popcorn, and optionally cooking oil or hydrogenated vegetable fat, is positioned within the construction 10, and the construction 10 is sealed across its ends by means of transversely extending bands 22 of adhesive, to form end seals 23 and 24 respectively. A variety of adhesives may be utilized.

If desired (FIG. 5), optional diagonally extending seals 26 can be provided between the gusset folds 14 and 16 and either or both of the front and rear panels 17, 19 of the bag at either or both ends of the construction 10 as described in U.S. Pat. Nos. 4,691,374; 5,044,777; and, 5,195,829, which are incorporated herein by reference.

A heat sealable adhesive that is suitable for the longitudinal seal 20 as well as the adhesive used for the end seals 23, 24 (and/or optional diagonal seals 26) is a polyvinyl acetate homopolymer adhesive such as Duracet 12 available from Franklin International, Inc. of Columbus, Ohio. The seals 23, 24, 26 can be formed by clamping the construction 10 between heated jaws (not shown) of a conventional heat sealing apparatus, to form air tight seals at the ends of construction 10, and to seal the gussets 14 and 16 in place at each end of the bag 13.

The construction 10 includes a microwave interactive construction 27 (FIG. 2) therein. For the preferred arrangement depicted, the microwave construction 27 is positioned on panel 17, by an adhesive field 28 (FIG. 2). (In FIG. 2, the layers of construction 27 are depicted "peeled", for clarity. That is, each layer is fragmented at a different location.)

Although a variety of arrangements may be used, the particular microwave interactive construction 27 for the preferred arrangement shown in FIG. 1 is viewable in cross-section in FIG. 2 and includes a susceptor layer 29 comprising a sheet 30 of metallized plastic film 31. That is, film 31 comprises a substrate 30, such as a piece of polymeric film, having thereon a semiconductive metal coating that is microwave active, i.e. that becomes hot when exposed to microwave energy, (e.g. a vacuum deposited metallic coating 32). For the particular embodiment shown, the substrate comprises a polyester film and the vacuum deposited metallic coating comprises aluminum. Useable microwave interactive materials are described in U.S. Pat. Nos. 4,641,005; 4,267,420; 4,230,924; 4,735,513; and, 4,878,765; each of which is incorporated herein by reference. Modifications from the arrangement of those references to accommodate the particular geometric constraints of the present application will be apparent from the present disclosure. In one useful embodiment, the vacuum deposited microwave active metallic coating 32 comprises an amount of deposited metallic material on Hoechst Celanese 2600 48 gauge polyester film sufficient to give an optical density of 0.25+0.05 as measured by a Tobias densitometer. Such a material can be prepared by, and obtained from, Madico of Woburn, Mass. 01888. Useable microwave interactive constructions are available from Phoenix Packaging of Maple Grove, Minn.

If desired, the susceptor layer 29 can be provided in other forms, such as those microwave interactive materials described in U.S. Pat. Nos. 4,970,358; and, 5,175,031 which are incorporated herein by reference. If the susceptor layer 29 is a printed coating, the patch 27 can comprise simply a sheet of paper having the microwave interactive pattern printed thereon (i.e. a separate plastic layer becomes unnecessary because a printed microwave interactive pattern can be applied directly to a paper substrate).

The laminating adhesive 28 comprises a packaging adhesive suitable for microwave packaging. For example, a ethylene vinyl acetate copolymer adhesive, Product No. WC-3460ZZ from H.B. Fuller Company of Vadnais Heights, Minn., can be used.

The susceptor construction 27 can be positioned either inside of the bag 13 or outside of the bag 13, depending on the use. For the arrangement shown in FIG. 1, the construction 27 is positioned on the outside of the bag 13 (i.e. on the outer surface 33 of construction 10, with the metal coating 32 facing outwardly or away from any food stored in an interior 34 of construction 10). Thus, interference with the food by materials in the microwave interactive construction 27 is minimized. It is foreseen, however, that in some instances the microwave interactive construction 27 may be positioned in an interior of the bag. Also, the construction 27 could be oriented with the relative locations of the coating 32 and the substrate 30 reversed; i.e. with the coating 32 between the outer surface 33 of construction and the substrate 30.

For the constructions shown in FIGS. 1 and 2, a paper sheathing layer 35 is positioned over the susceptor layer 32. The sheathing layer 35, for the embodiment shown, comprises a flexible sheet of paper. The sheathing layer 35 is secured to the metal layer 32 by adhesive field 28*a* (FIG. 2). Preferred papers for the construction are described herein below. If the microwave interactive material is a printed pattern, it can be applied to paper configured like the sheathing layer 35, without the other layers of construction 27.

If desired, the susceptor construction 27 can be manufactured as a multi-layer laminate; the laminate, for example, comprising the paper sheath and a polymeric film with the metallic material sandwiched therebetween. When such arrangements are used, the susceptor construction 27 can be applied to the bag 13, as a preformed unit or patch. Feedstock comprising an appropriate laminate of paper sheathing and metallized substrate, for use in cutting microwave constructions 27, is available from Phoenix Packaging of Maple Grove, Minn.

For the particular arrangement shown in FIG. 1, the susceptor layer 29 is generally rectangular, and is positioned on a central portion 36 of surface 17. For the arrangement of FIG. 1, the protective sheathing layer 35 substantially mimics the size and shape of the susceptor layer 29 in a preferred manner. That is, both the susceptor layer 29 and the sheathing layer 35 have first and second transversely extending parallel opposing end edges 37 and 38, and first and second opposing, longitudinally extending side edges 39 and 40. Thus, for the arrangement shown in FIG. 1, the sheathing layer 35 is the same size and shape as the susceptor layer 29. Variations on this are possible, and advantageous ones are described herein.

In general, the susceptor layer 29 should be positioned on construction 10 at a location which will be underneath the food charge (i.e. popcorn charge 21) when the construction 10 is in position in a microwave oven, for heating or cooking. Also, except for preferred border portions described below, preferably at least the microwave interactive metallic material on the susceptor layer 31 does not occupy a substantially greater space than that space which will be overlapped by the food charge (i.e. popcorn charge 21). It is not necessary that the metallic material completely occupy all of the surface area of susceptor layer 29. That is, the metallic material could be provided in a pattern, although such will generally not be preferred.

As explained above, in general susceptor construction 27 is positioned in a central portion of front face 17. Positioning of the susceptor material in the present embodiment, yields advantages with respect to pop volume.

In particular, after the construction 10 has been filled and sealed at both ends, it is preferably folded transversely into a trifold, along laterally extending and longitudinally spaced apart parallel transverse fold lines A and B (see FIGS. 1, 4 and 5) so that construction 10 can be made more compact with the popcorn charge 21 located between the fold lines A and B. The construction 10 is then prepared for storage or shipment, by being sealed in a protective envelope or sheath such as enclosure 45, FIG. 3. The envelope 45 or sheath can comprise, for example, a plastic film or cellophane. In this context, the term "transverse" is meant to refer to folds which extend across the front and back panels, i.e. between the side gussets. The transverse fold lines divide the arrangement 10 into a central portion bordered by opposite end portions. It is noted that, in typical constructions, fold lines A and B will be rounded, "soft" or non-creased folds; in contrast to the folds which form the gussets 14,16.

Figure 4:
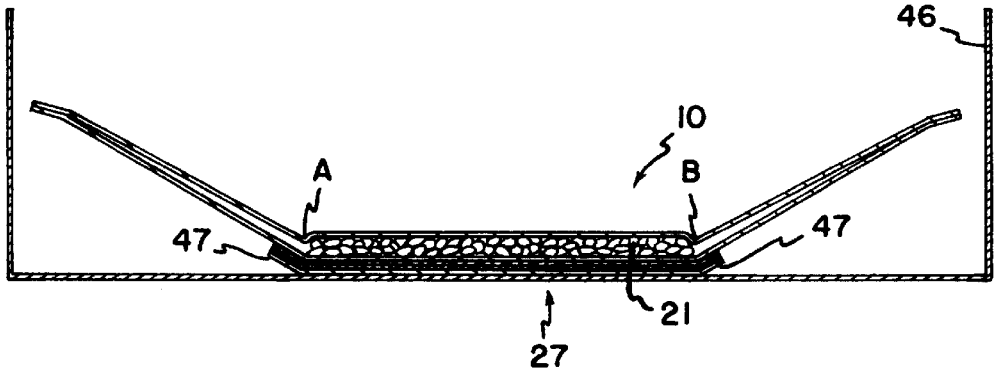
FIG. 4 is a schematic cross-sectional view of a construction in accordance with the embodiment of FIG. 1, shown as it would appear when unfolded and placed in a microwave oven for a process of microwave cooking.

In use, after the construction 10 is removed from envelope 45, it is unfolded and set in a microwave oven 46 as shown in FIG. 4. The popcorn charge 21 is located between fold lines A and B and thus for the preferred construction shown, the susceptor construction 27 will be positioned similarly with the metallic material thereof primarily occupying a space between fold lines A and B, underneath the charge 21. This way efficient utilization of heat generated by the metallic material in the susceptor, is accomplished.

For the embodiment shown in FIGS. 1, 2, 4 and 5, the susceptor construction 27 is long enough to extend somewhat, for example at least without 0.25 inch (0.64 cm) and typically and preferably about 0.5–1.0 inch (1.25–2.54 cm), beyond the fold lines A and B and toward the respective opposite ends of the construction 10 (see especially FIG. 4). In this manner, the susceptor patch 27 reinforces the flexible (paper) material in the region of fold lines A and B, reducing the likelihood of any seepage at this location, i.e. seepage of hot liquid or liquified oil (if present) to an outside of the bag 13. Also, the resulting upwardly turned portions 47 of construction 27 (FIG. 4) serve to retain and concentrate heat. In some embodiments, portions of susceptor construction 27 can extend much further beyond fold lines A and B than just 0.5–1.0 inches (1.25–2.54 cm). Indeed, they may extend all the way to the opposite ends. For example, if desired sheath 35 could be extended the complete length of construction 10.

It is noted that when the sheathing layer 35 is of appropriate material and thickness, it can, when positioned on the outside of bag 13, act as an insulator to reduce heat loss in directions away from an interior 34 of construction 10 (in use). Thus, the protective sheathing layer 35 can be used to help direct heat generated within the susceptor layer 29 towards (during microwave heating) the front panel 17 of construction 10 and to the popcorn charge 21 where it is absorbed to help pop the corn and/or heat any oil/fat present in the popcorn charge 21. In addition, especially when used on an exterior of construction 10, the protective paper sheathing layer 35 forms a good printing surface for printed indicia 48 (FIG. 1) to provide, for example, instructions, ingredient information and/or decoration for the package. The preferred materials, described hereinbelow for the sheathing layer 35, are materials which can be used as surfaces to receive printing and also which will provide some beneficial effects with respect to retention of heat within construction 10.

In general, portions of construction 10 which are most likely to either rupture during use, or provide for leakage of oil during use, are those portions which are sharply creased or folded. The gusset folds 14 and 16 (FIG. 1) each involve three such portions, namely outwardly directed fold 50, central, inwardly directed, fold 51, and outwardly directed fold 52 respectively. One of these portions, in particular the portion located at 50, is an outwardly directed crease-fold located in a portion of construction 10 which will be toward the bottom, when the arrangement 10 is used during a cooking operation. Since it is toward the bottom, and extends adjacent a part of the bag whereat a charge of popcorn is located in use, if the popcorn charge 21 includes oil or grease therein, the oil or grease is likely to come into contact with fold 50, during heating. By "inwardly" or "outwardly" directed in this context, reference is made to the direction the crease extends from the two panels which form it relative to a center portion of the bag construction.

As a result of the above, it is desirable to provide reinforcement to bag 13 in the vicinity of folds 50. In the preferred embodiment shown in FIGS. 1 and 2, the reinforcement is done with portions of construction 27.

In particular, the microwave interactive construction 27 (FIGS. 1 and 2) includes opposite side extensions 53 and 54 thereon, which extend beyond the two gusset fold creases 50, and into the gusset fold somewhat, preferably at least about 0.125 inch (0.32 cm) and most preferably about 0.25 to 0.5 inch (0.64–1.25 cm). The material from which construction 27 is formed, then, provides reinforcement along fold creases 50 at this location, reducing the likelihood of leakage from construction 13 at these locations, without requiring the entire construction 13 to be made from a multi-ply material.

An Alternate Embodiment

In FIG. 7, an alternate embodiment of the present invention is depicted. In general, in FIG. 7 the construction 70 depicted comprises a bag construction analogous to the bag construction of FIG. 1. Thus, construction 70 comprises a bag 73 formed from material 74 to have: front and back panels (only front panel 75 being visible in FIG. 7) opposite side gussets 80 and 81; and, opposite end seals 84 and 85, respectively. Construction 70 includes a microwave interactive construction 90 thereon. The susceptor construction 90 may be generally analogous to susceptor construction 27, except it is configured with a slightly different shape. In particular, although, like construction 27, susceptor construction 90 is rectangular, it does not include portions which fold past fold lines 92 and 93, and into gussets 81 and 80. Rather, construction 90 fits entirely on panel 75. If used at all, it would probably be most useful in arrangements involving little or no oil/fat.

A Further Alternate Embodiment

Figure 8:
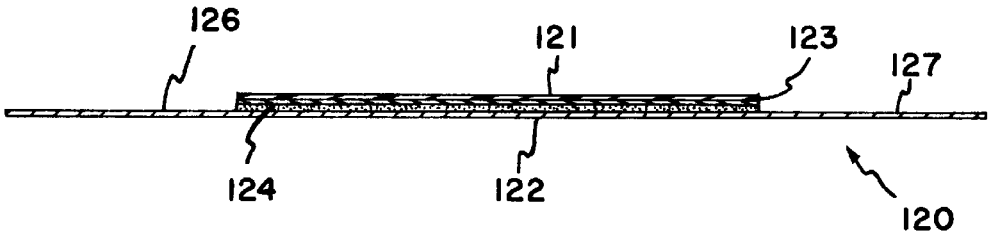
FIG. 8 is a cross-sectional view of a component including microwave susceptor material, useable in an alternate embodiment according to FIGS. 9–11.

In FIG. 8, a microwave interactive construction 120 is depicted (in cross-section), which can be used to advantage in certain embodiments. In use, construction 120 would be attached to a bag construction, as shown in FIG. 9. Still referring to FIG. 8, construction 120 is a multi-layer laminate construction having: a first backing 121; a second backing 122; and, a microwave interactive layer 123. For the particular arrangement shown, microwave interactive layer 123 comprises metallic material secured to backing 121, for example, by vacuum deposition. In the embodiment shown, backing 121 comprises a sheet of polymeric material, such as polyester, to which metallic material 123 is secured by vacuum deposition. During assembly, backing 121 with metal 123 thereon, is secured to backing 122 by means of adhesive 124. Backing 122, for the preferred embodiment, is paper.

Backing 122 includes sections 126 and 127, which, when arrangement 120 is secured to bag construction as shown in FIGS. 9 and 10, are sufficiently long so that reinforcement of all three folds or creases used to form each of the two side gussets is provided. This will be understood by reference to FIG. 10, which is a cross section of a bag construction involving microwave interactive construction 120. As with FIG. 2, in FIG. 10 the microwave interactive construction 120 is depicted with portions of layers broken away in a step wise fashion, for clarity. The construction 120 is secured to the bag 140, by adhesive field 125.

Referring to FIGS. 9 and 10, bag construction 140 is depicted. Bag construction 140 is a single-ply bag formed from a paper material 141. Construction 140 includes front and back panels 142 and 143 respectively. Construction 140 is generally formed from a continuous bag folding operation and thus it includes a single, longitudinal seam 145, in panel 143. Bag construction 140 is provided with ends 147 and 148.

Bag construction 140 includes opposite side gussets 151 and 152, each including three folds therein. The three creases or folds in side gusset 151 are indicated at 155, 156 and 157. The corresponding creases or folds in side gusset 152 are indicated at 160, 161 and 162 respectively.

Construction 120 is positioned on panel 142. Preferably it is secured thereto by means of an adhesive, as shown at 125. It is secured such that panel 122 is a sheath positioned over metal layer 123 and panel 121. Preferably the metallic field 123 is sized similarly to the metallic field in arrangement 27, FIGS. 1 and 2, wherein a portion of panel 121 and metallic layer 123 folds over folds 157 and 162, into side gussets 151 and 152, respectively, somewhat, i.e. preferably at least about 0.125 inch (0.32 cm) and more preferably about 0.25 to 0.5 inch (0.64–1.25 cm).

Regions 126 and 127 of panel 122, on the other hand, are sufficiently long to provide reinforcement not only to folds 157 and 162, but also to folds 155, 156, 160 and 161, as shown in FIGS. 9 and 10. Thus, while panel 121 and metal 123 do not extend completely across side gussets 151 and 152, sheathing 122 does. In this manner, reinforcement to a portion of bag construction 140 in desirable locations, i.e. where the crease folds or seams are likely to encounter hot fat or oil is provided, without placing microwave interactive material undesirably in certain locations. From the description it will be understood that the arrangement of FIGS. 9 and 10 is particularly desired for use when the construction will involve either of: a popcorn charge having a substantial amount of oil or grease therein; or, an arrangement which will generate a substantial amount of hot steam during use, which could weaken the construction in the regions of the folds.

It will be understood that preferably construction 120 is sized so that its end edges 170, 171 will extend beyond transverse fold lines C and D, analogously to fold lines A and B, FIGS. 1 and 5, to advantage. Of course, portions of construction 120 could be extended beyond fold lines C and D all the way to opposite ends of construction 140, if desired.

From the above descriptions, certain advantages to the arrangements as of FIGS. 1 and 9, relative to the arrangement of FIG. 7, will be apparent. In the arrangement of FIGS. 1 and 9, the metal layer of the microwave interactive construction includes an upwardly turned outer peripheral portion substantially surrounding the popcorn charge, when the arrangement is placed in an oven for a popping operation. For both of the arrangements of FIGS. 1 and 9, the upwardly turned portion of metal is formed from: the portion of the corresponding susceptor construction which extend beyond the trifold lines A (or C) and B (or D); and, also the portions which wrap into the gusset folds. That is, in the arrangements of FIGS. 1 and 10, the microwave interactive material is dish shaped, when used. In use, heat generated by the metallic material of the upwardly turned (rim) locations will tend to help form a heated dish in which the popcorn oil resides, during use. This will help retain heat desirably, and encourage better popping. In contrast, the arrangement of FIG. 7 only includes an upwardly turned portion of the metallic material in regions extending beyond the "trifold" lines.

Figure 12:
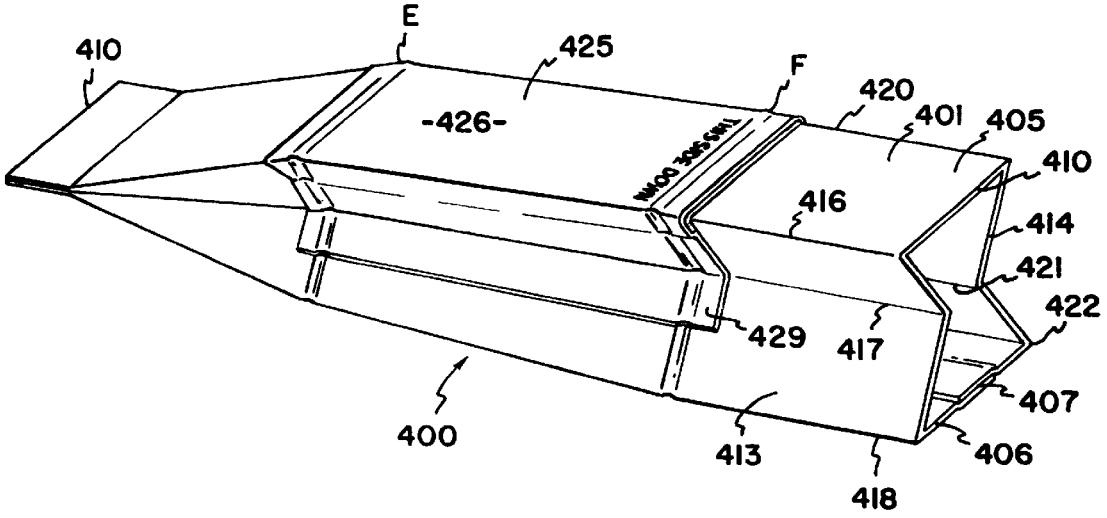
FIG. 12 is a perspective view of an arrangement according to a third alternate embodiment of the present invention.

The Alternate Embodiment of FIG. 12

FIG. 12 is a perspective view of an arrangement occurring to a third alternate embodiment of the present invention. Except as described, the arrangement of FIG. 12 may be generally analogous to those of FIGS. 1 and 9.

Referring to FIG. 12, bag construction 400 is depicted. Bag construction 400 is a single ply bag formed from a paper material 401. Construction 400 includes front and back panel 405 and 406 respectively. Construction 400 is generally formed from a continuous bag folding operation and thus it includes a single longitudinal seam 407 in panel 406. Bag construction 400 is provided with ends 409 and 410.

Bag construction 400 includes opposite side gussets 413 and 414, each including three-folds therein. The three creases or folds and side gusset 413 are depicted at 416, 417 and 418. The corresponding creases or folds in side gusset 414 are indicated at 420, 421 and 422 respectively.

Microwave interactive construction 425 is positioned on panel 405. Preferably, it is secured thereto by means of an adhesive. It can be secured similarly to construction 120 of FIGS. 9 and 10, and is similarly constructed and positioned. It is secured such that sheath 426 (analogously to sheath 122 for the arrangement of FIGS. 9 and 10) is positioned over metal material. Preferably, the metallic field for microwave interactive construction 425 is sized similarly to that of metallic field 123 for FIGS. 9 and 10, with a portion extending into the side gussets somewhat, i.e. preferably at least 0.125 inch (0.32 cm) and more preferably about 0.25 to 0.5 inch (0.64–1.25 cm).

Side regions (429 region and an opposite region not viewable) of sheath 426, on the other hand, are sufficiently long to provide reinforcement not only to folds 416 and 420, but also to folds 417 and 421. They do not, however, extend as far as folds 418 and 422 respectively.

Thus, the arrangement of FIG. 12 can be understood to be generally analogous to that of FIG. 9, except that the sheath 426 reinforces only the first and second creases of the gusset folds, adjacent the front panel, and the sheath on each side of the arrangement does not extend to and around the third gusset fold. Such an arrangement may be convenient and desirable, if there is a practical limit to the width of material that can be fed into the process for making the arrangement, either due to supply limitations or machining limitation encountered. As with the arrangements of FIGS. 1–11, preferably the microwave interactive construction 425 extends toward ends 409 and 410, past the transverse fold line E and F somewhat, preferably at least an amount analogous to that described with respect to embodiments shown in previously discussed figures. If desired, the sheath 426 of microwave interactive construction 425 can be made sufficiently along to extend all the way between opposite ends 409 and 410.

Assembly of Constructions According to the Present Invention

While a variety of methods may be utilized to construct arrangements according to the present invention, it is an advantage of preferred constructions according to the present invention that they are well adapted to be manufactured and continue to feed operations. This is exemplified in FIG. 6, which depicts schematically a method of producing an arrangement according to FIGS. 1 and 2; and, in FIG. 11, which schematically depicts a method of forming an arrangement according to FIGS. 9 and 10. The arrangements of FIGS. 7 and 12 could be readily made using the techniques and principles described with respect to either of FIGS. 6 and 11.

Methods of Construction

Referring to FIG. 6, a web or sheet 200 of material 201 (preferably single ply) is fed over a roll 202, outwardly around support rolls 203 and 204, and then toward a location 210 whereat it is continuously folded into bag 211 having side gussets 212 and 213. This can be accomplished with conventional form filling equipment, if desired. However, the operation is facilitated since a single-ply material can be used for web 200. A web 220 of microwave interactive material, i.e. metallized plastic film, is combined with a web 221 of sheathing paper stock at 225. In particular, webs 220 and 221 are adhesively bonded together as they pass through a nip or bite 226 between feed rolls 228 and 229. From there, the resulting composite microwave construction 235, comprising laminated webs 220 and 221, passes downwardly past a reciprocating cutting knife 238 which cuts the continuous composite construction 235 into individual susceptor constructions or patches 240. The cut susceptor constructions 240 are then transferred (for example, as shown by rotating vacuum drum 241 having vacuum openings 242) onto the continuous web 200 of bag-forming material in an appropriate position. Adhesive to accomplish this securement is applied to web 200 at 245. (Adhesive for securing web 221 to web 220 is applied at 246.) During operation, the composite web or construction 235 is held against a surface of the drum 241 by suction applied to the vacuum openings 242. As the reciprocating knife 238 cuts the web 235 at spaced apart intervals, the drum 241 presses and applies the individual susceptor constructions 240 onto the web material 200 at each selected successive area. Next, the web 200 passes over the rotating support rollers 203 and 204, and is rerolled for later use in making bag constructions or, if desired, is carried directly through to the bag former 210. The bag former 210 shown includes a centrally located folding form 251 and a pair a laterally spaced apart centrally extending gusset forming plates 252 and 254. A longitudinal seam 255 is then formed by applying heat and pressure to overlapped edges of preglued paper. The resulting paper tube is then periodically severed and sealed transversely with a seal to form top, bottom, and end seals in the bag. Before complete sealing, the construction will have been provided with a charge of popcorn.

Constructions in accord with the present invention can be hand assembled or, if desired, the susceptor construction can be applied to preformed bags.

A method of manufacturing an arrangement according to FIGS. 9 and 10, is shown in FIG. 11. It will be understood that the method of operation is similar to that shown in FIG. 6. However, a major difference is present. More specifically, referring to FIG. 11, the web 300 which forms the outer protective paper sheath 122 of the microwave interactive construction 120, when construction 120 is formed, is much wider than the extension of plastic substrate 121 having metal 123 thereon. Lamination of the continuous plastic/metal/sheath construction 305 to the continuous extension of paper 300 is shown, in FIG. 11, generally at 310. It will be understood that the resulting composite 311, after being appropriately cut, is applied to the continuous web 315 from which the bag is formed, such that wings 126 and 127, of construction 120 will fold into the opposite gussets appropriately.

Preferred Materials

As was generally explained above, advantages to constructions according to the present invention result, at least in part, from preferred selection of materials. In particular, a single ply material can be selected for the formation of the bag, provided it is of an appropriate flexible material and a microwave interactive construction is appropriately located on the bag. In this manner, desirable storage stability and grease impermeability during cooking can be obtained while at the same time good flexibility for expansion during use is provided. Preferred materials utilizable in constructions according to the present invention are as follows:

The single ply web from which the bag panels and gussets are formed can be selected from a variety of materials. Preferably a flexible paper material, having a basis weight no greater than 45 lbs. per ream (or about 73 grams/square meter) and generally of about 25–40 lbs. per ream (about 57 $g/m^2$) or less, more preferably about 35 lbs. per ream, is used. Regardless of whether the arrangement is used with popcorn popped in the absence or presence of added fat/oil, preferably the paper is one which has been chemically treated to have some grease proof or grease resistant character. For example, refined papers treated with grease proofing chemicals, will be preferred.

The following commercially obtainable materials can be used as the web: RHI-PEL 371, available from Rhinelander Paper Company of Rhinelander, Wis. 54501. This is a refined, chemically treated sheet made of 100% chemical softwood pulp. It has a basis weight of 35 lbs. per ream. The chemical used for the treatment, to render a grease proof or grease resistant character to the paper is Scotchban™ FX845. The chemical Scotchban™ FX845 is a chemical that imparts grease and oil resistance to paper, paper board and coatings, commercially available from Minnesota Mining and Manufacturing Company of St. Paul, Minn.a 55144–1000.

If the single-ply paper is going to be utilized with a popcorn composition which does not involve added fat/oil, further chemical treatment to impart a greater grease resistance or grease proof character to the paper, will not generally be necessary or desired. That is, a paper such as RHI-PEL 371 will exhibit sufficient grease resistance, especially if reinforced by the microwave interactive construction along some or all of the fold lines as described with respect to the figures.

However, in many applications the popcorn charge will include added fat/oil, which, when hot, will tend to permeate material which has only been treated in the manner of RHI-PEL 371, when commercially obtained. For such arrangements, it may be desirable to provide additional coatings on the paper. Useable coatings are those available from Elektromek Co. of Carlstadt, N.J. 07072 under the trade names WC 4891 and WC 4130. In general, WC 4891 is a flexible base coat to penetrate fibers and WC 4130 is a topcoat to sit on the surface and provide a barrier coating. These grease proof coatings would be applied to the portions of the single-ply paper whereat the gusset folds (creases) are located and whereat the surface having the popcorn charge resting thereon in use, is located. The materials would preferably be applied to the paper web in those portions which include gusset folds. The application would generally not be applied to portions of the back panel in which the seam is located, for example in the embodiments of FIGS. 1 and 10. What is being suggested, with respect to the locations of application to these two materials, is that high grease proof or grease resistant character is only required in selected portions of the single-ply construction. Thus, the drawbacks to such materials can be avoided in other locations. If coatings such as WC 4891 and WC 4130 are used, they may be applied in conventional manners as recommended by the supplier for imparting grease proof character to paper and paper materials.

As an alternative, grease proof character could be provided with starch based coatings. Once such material that is commercially available is obtained under the designation Redisize 100 from National Starch and Chemical Co., Minneapolis, Minn. 55344.

For the microwave interactive construction, microwave interactive sheets can be construction from materials similar to those described in U.S. Pat. Nos. 4,641,005; 4,267,420; 4,230,924; 4,735,513; and, 4,878,965 incorporated herein by reference. Such sheets, if premade prior to application to the web used to form the back construction, generally comprise a metallized polymeric film (typically 48–75 gauge polyester metallized with aluminum), laminated to paper stock, typically with the metal positioned between the polymeric sheet and the paper.

Useable commercially available microwave interactive materials are available from Phoenix Packaging of Maple Grove, Minn. A preferred one comprises Hoechst Celanese 2600 48 gauge (0.048 inches) polyester film which has been vacuumed metallize with aluminum to give an optical density of 0.25±0.05 as measured by a Tobias densitometer, laminated to a 23 lb. grease proof paper, such as RHI-PEL 250 available from Rhinelander. The lamination can be done with H.B. Fuller WC-3460ZZ (ethylene/vinyl acetate copolymer) adhesive. A company which can metallize polyester film to the specification stated is Madico of Woeburn, Mass. 01888.

In general, the same adhesive can be utilized for applying a microwave interactive construction to the paper stock of the bag construction, as is used to secure the metallized polyester film to the paper sheath of the microwave interactive construction. H.B. Fuller WC-3460ZZ is, for example, useable for both applications.

What is claimed is:

1. A construction for containing a charge of popcorn to be heated during a microwave heating operation; said construction comprising:

(a) a flexible single-ply bag comprising flexible paper; said bag having first and second, opposite, ends and an outer surface;

(b) said bag including front and back panels each having opposite side edges; said bag further including first and second, opposite, gussets extending between said front and back panels; said front panel having a central portion; each of said gussets comprising:

(i) a first, outwardly directed, gusset fold where the gusset is secured to the front panel;

(ii) a second, outwardly directed, gusset fold where the gusset is secured to the back panel; and, (iii) a third, central, inwardly directed, gusset fold; each of said gussets extending completely between said first and second bag ends; and (c) a microwave interactive construction secured to said outer surface of said bag; said microwave interactive construction including a layer of microwave interactive metallic material; said microwave interactive construction being oriented such that said layer of microwave interactive material does not extend completely between said first and second ends of said bag; said microwave interactive construction being secured to said front panel by adhesive positioned on said central portion of said front panel, between said side edges;

(i) said microwave interactive construction comprising a laminate including:

(A) a layer of flexible paper having a basis weight of no greater than about 45 lbs. per ream; and, (B) a layer of flexible plastic material;

(C) said layer of microwave interactive material being positioned between said layer of flexible paper and said layer of flexible plastic material;

(ii) said microwave interactive construction being secured to said bag with said layer of flexible plastic material and said layer of microwave interactive metallic material positioned between at least a portion of said layer of flexible paper, and said bag outer surface; and, (iii) said microwave interactive construction including a portion of said layer of flexible paper which is secured directly to said bag outer surface, without any portion of said plastic layer and said metallic layer there between.

2. A construction according to claim 1 wherein said flexible single-ply bag comprises flexible paper having a basis weight of no greater than 45 lbs. per ream.

3. A construction according to claim 1 wherein:

(a) said microwave interactive construction includes:

(i) a first gusset portion in said layer of flexible paper which is oriented to reinforce a section of said third gusset fold, in said first gusset, without any of said layer of metallic material being between said first gusset portion of said layer of flexible paper and said bag, in the reinforced section of said third gusset fold in said first gusset; and, (ii) a second gusset portion in said layer of flexible paper which is oriented to reinforce a section of said third gusset fold, in said second gusset, without any of said layer of metallic material being between said second gusset portion of said layer of flexible paper and said bag, in the reinforced section of said third gusset fold in said second gusset.

4. A construction according to claim 1 wherein:

(a) said microwave interactive construction includes a portion thereof oriented:

(i) to reinforce said bag along a portion of said first gusset fold in said first gusset; and, (ii) to reinforce said bag along a portion of said first gusset fold in said second gusset.

5. A construction according to claim 4 wherein:

(a) said portion of said microwave construction which is oriented to reinforce said bag along a portion of said first gusset fold in said first gusset comprises a portion of said microwave construction including a layer of metallic material therein; and, (b) said portion of said microwave construction which is oriented to reinforce said bag along a portion of said first gusset fold in said second gusset comprises a portion of said microwave construction including a layer of metallic material therein.

6. A construction according to claim 1 wherein:

(a) said microwave interactive construction includes a portion thereof oriented:

(i) to reinforce said bag along a portion of said first gusset fold in said first gusset; and, (ii) to reinforce said bag along a portion of said first gusset fold in said second gusset.

7. A construction according to claim 6 wherein:

(a) said portion of said microwave construction which is oriented to reinforce said bag along a portion of said first gusset fold in said first gusset comprises a portion of said microwave construction including a layer of metallic material therein; and, (b) said portion of said microwave construction which is oriented to reinforce said bag along a portion of said first gusset fold in said second gusset comprises a portion of said microwave construction including a layer of metallic material therein.

8. A construction according to claim 1 wherein:

(a) said bag construction includes first and second, spaced, transverse folds thereacross; said first and second transverse folds dividing said bag construction a central portion with first and second, opposite, end portions; and, (b) said microwave interactive construction is positioned on said bag construction central portion, with:

(i) a first portion of said layer of metallic material extending beyond said first transverse fold from said central portion; and, (ii) a second portion of said layer of metallic material extending beyond said second transverse fold, from said central portion.

9. A construction according to claim 1 wherein:

(a) at least a portion of said single-ply bag comprises paper:

(i) including a fiber penetrating base coat, for grease resistance; and, (ii) having a top coat of grease resistant material thereon.

10. A construction according to claim 1 including:

(a) a charge of oil/fat mixed with said charge of popcorn.

11. A construction according to claim 1 wherein:

(a) said microwave interactive construction includes:

(i) a first gusset portion in said layer of flexible paper which is oriented to reinforce a section of said third gusset fold, in said first gusset, without any of said layer of plastic material and said layer of metallic material between said first gusset portion of said layer of flexible paper and said bag, in the reinforced section of said third gusset fold in said first gusset; and, (ii) a second gusset portion in said layer of flexible paper which is oriented to reinforce a section of said third gu&set fold, in said second gusset, without any of said layer of metallic material between said second gusset portion of said layer of flexible paper and said bag, in the reinforced section of said third gusset fold in said second gusset.

12. A construction according to claim 1, wherein:

(a) said microwave interactive construction includes a portion reinforcing a part of said first gusset fold, in each gusset, extending adjacent a part of said bag whereat a charge of popcorn is located, in use.

* * * * *

UNITED STATES PATENT AND TRADEMARK OFFICE

CERTIFICATE OF CORRECTION

PATENT NO. : 5,773,801

DATED : JUNE 30, 1998

INVENTOR(S) : BLAMER ET AL.

It is certified that error appears in the above-identified patent and that said Letters Patent is hereby corrected as shown below:

Front page, [56] References Cited, U.S. Patent Documents: insert —5,200,590 4/1993 Bowen et al.— in numerical order.

Col. 16, line 29: "gu&set" should read —gusset—

Signed and Sealed this

Eleventh Day of January, 2000

*Attest:*

Q. TODD DICKINSON

*Attesting Officer*

*Acting Commissioner of Patents and Trademarks*